US005799336A

United States Patent [19]

Cooper

[11] Patent Number: 5,799,336

[45] Date of Patent: Sep. 1, 1998

[54] PROTECTIVE GARMENT WITH DETACHABLE FLEXIBLE POUCH

[76] Inventor: Meredith K. Cooper, 4500 Four Mile Run Dr. #429, Arlington, Va. 22204

[21] Appl. No.: 744,665

[22] Filed: Nov. 6, 1996

[51] Int. Cl.[6] ..... A41D 27/20; A41D 3/00

[52] U.S. Cl. ..... 2/247; 2/46; 2/252; 2/69; 2/912; 2/920

[58] Field of Search ..... 2/46, 49.1, 49.2, 2/49.3, 49.4, 49.5, 50, 51, 52, 69, 69.5, 70, 71, 72, 75, 80, 86, 94, 88, 89, 247, 248, 249, 250, 251, 252, 912, 913, 914

[56] References Cited

U.S. PATENT DOCUMENTS

| | | | |
|---|---|---|---|
| 314,333 | 3/1885 | Heller | 2/247 |
| 1,596,533 | 8/1926 | Haubenstock | 2/247 |
| 2,389,697 | 11/1945 | Stoeckert | 2/247 |
| 2,557,445 | 6/1951 | Lewallen | 2/247 |
| 2,591,059 | 4/1952 | Frohman | 2/247 |
| 3,285,307 | 11/1966 | Dormaier | 2/209.11 |
| 3,522,612 | 8/1970 | Palmer | 2/88 |
| 3,611,444 | 10/1971 | Rector | 2/247 X |
| 4,218,781 | 8/1980 | Lieberman | 2/247 |
| 4,404,689 | 9/1983 | Dewan | 2/247 |
| 4,602,390 | 7/1986 | Morera et al. | 2/247 X |
| 4,899,395 | 2/1990 | Spector | 2/249 |
| 5,003,637 | 4/1991 | Lonon | 2/249 |
| 5,054,127 | 10/1991 | Zevchak | 2/250 |
| 5,067,178 | 11/1991 | Katchka | 2/247 |
| 5,463,783 | 11/1995 | Pope | 2/88 |
| 5,509,147 | 4/1996 | Busquets | 2/247 X |

*Primary Examiner*—Jeanette E. Chapman

*Attorney, Agent, or Firm*—Arent Fox Kintner Plotkin & Kahn, PLLC

[57] ABSTRACT

The present invention is directed to a flexible pouch comprising a container portion and a neck portion. The neck portion is integrally connected to the container portion. The container portion may be constructed of flexible, elastic material with a water-impermeable layer, which is expandable to accommodate the insertion and storage of cleaning articles therein. The neck portion may be constructed of flexible, elastic material which includes an opening of a sufficient size to allow the insertion and extraction of cleaning articles to and from the container portion. The flexible, elastic material of which the pouch is constructed includes two panels of equal size and shape which are securely and cooperatively affixed to one another in parallel orientation about their circumferential edges to form the flexible pouch. Closure means are employed for narrowing the opening in the neck portion and retaining the contents therein. The flexible pouch may be attached to the interior of a flexible shroud or bib at a longitudinally extending horizontal opening made in the shroud or bib, so that access may be gained to the flexible pouch from the exterior of the shroud or bib.

6 Claims, 2 Drawing Sheets

PROTECTIVE GARMENT WITH DETACHABLE FLEXIBLE POUCH

BACKGROUND OF THE INVENTION

The present invention is directed to a new expandable flexible pouch which is used in conjunction with a baby bib, hair care or cosmetic shroud, or recreational clothing to store tissues or other cleaning or drying materials. The present invention is an improvement over existing expandable flexible pouches used for these purposes, which finds particular utility as an innovative, easy to use, cost-effective, detachable means for providing a convenient, portable source of cleaning or drying materials. The flexible pouch of the present invention finds further utility when retained by a garment around whose working area cleaning or drying may be required on an immediate, as-needed basis. This device may also be suitable for use in a variety of other cleaning and drying applications or in any situation which requires quick, convenient access to cleaning and drying materials.

For instance, in the case of a baby bib, the feeding of a young child is often messy, with food or liquid materials being spilled on the bib, on the child's face or on clothing. It is often necessary to effectuate rapid cleanup of such spills in order to avoid discomfort to the child or the soiling of the child's clothing, the parent's clothing or surrounding furniture. In addition, during hair styling or cosmetic application activities, chemicals, dyes or cosmetics, such as powder or eye shadow or the like, may fall onto the face or clothing of the customer. Even if the customer is wearing a cape or shroud, rapid cleanup or drying of these materials may be required to avoid discomfort to the customer or the soiling of his or her clothing caused by liquid soak-through. Finally, during recreational activities, particularly those activities, such as exercise, which generate perspiration, it is often convenient to have access to drying materials which will aid in removing such perspiration to improve comfort and to avoid impairment of vision, etc. There is therefore a need for a flexible pouch which can be attached to a bib or other garment that will provide rapid, easy access to cleaning or drying materials at or near the point of application, in order to avoid soiling or to remedy discomfort.

Conventional pouches known in the art suffer from several disadvantages. Some are rigid and lack flexibility and expandability. Therefore their versatility is limited, as is their convenience. Other flexible pouches take the form of pockets which can be selectively attached to the exterior of articles of clothing by adhesive means. These pockets are similar to ordinary pockets which are found on shirts and pants. They are therefore generally open at the top, noncloseable and very often they are not expandable or flexible. There are also many types of bibs or covering shrouds known in the art. For example, U.S. Pat. No. 3,540,060 issued to Brown includes a bib which consists of a water impermeable backing with a disposable front. This bib also has a pocket which is created by the folding over of the flexible backing, which is then affixed at two points. This pocket is neither detachable, nor is it closeable, but is instead open at the top.

In addition, the combined bib and storage pouch which is the subject of U.S. Pat. No. 5,483,701 discloses a pouch with a drawstring closure mechanism which is attached to the bib. However, when the bib is unfolded, the pouch hangs upside down on the interior of the bib, and can therefore not hold any useful article in an accessible fashion. This pouch is instead intended for use as the receptacle and carrying means for the bib itself. Finally, it is known in the art to retain on clothing pockets or pouches containing cleaning materials, such as tissues. However, as is seen in U.S. Pat. Nos. 5,054,127 and 5,042,091, issued to Zevchak and Tonkens, respectively, pockets which may contain tissues and other cleaning materials are prominently retained on the exterior of a garment. Therefore, these pockets may impede movement and interfere with the very functions, such as eating, the application of cosmetics, hair styling and exercise, that they are intended to assist. In addition, because these external pockets are detachable, they may be knocked loose from the garment, thus defeating their purpose of providing rapid, convenient access to these cleaning or drying materials.

SUMMARY OF THE INVENTION

It is therefore an object of the present invention to provide an inexpensive, easily manufactured, and low-cost flexible pouch for retaining and allowing easy, rapid access to tissues, pre-moistened towelettes and other cleaning or drying materials.

It is a further object of the invention to retain this flexible pouch on the interior of a bib, shroud or other protective or recreational garment so that the pouch does not impede movement or accidentally become detached during use.

It is still a further object of the present invention to provide a flexible pouch which can be attached to the interior of a bib, shroud or other protective or recreational garment so as to provide easy and rapid access to the materials contained therein.

It is an additional object of the invention to provide a flexible pouch which is detachable and which can be disposed of after use, or refilled with further cleaning or drying materials.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects of this invention and in accordance with the purposes of the invention, as embodied and broadly described herein, this invention, in one aspect, includes a flexible pouch comprising a container portion and a neck portion. The neck portion is integrally connected to the container portion. The container portion is constructed of a flexible material which allows it to expand to accommodate the insertion and storage of cleaning articles therein for use during eating, cosmetic application, hair styling, recreational activities and the like. The neck portion is also constructed of a flexible material. The neck portion includes an opening at the upper end of a sufficient size to allow the insertion and extraction of cleaning articles to and from the container portion.

The flexible material of which the container and neck portions are constructed includes two panels of equal size and shape which are securely and cooperatively affixed to one another in parallel orientation about their circumferential edges to form the flexible pouch. Closure means are attached to the neck portion for narrowing the opening made thereby. Such closure means may include a drawstring which continuously and circumferentially extends around the base of the neck. Other closure means may consist of cooperative hook and loop strips affixed to opposite sides of the interior of the neck portion.

The user of the flexible pouch may wish to store pre-moistened towelettes therein. In such a situation, the flexible material of which the flexible pouch is constructed may be made of a water impermeable fabric or material. For cosmetic purposes, a water impermeable layer of flexible material may be surrounded by a second layer of fabric material.

This invention, in another aspect, includes the use of this flexible pouch in conjunction with a protective garment, such as a bib, smock, shroud or cape that is used during eating, the application of cosmetics, hair styling, recreational activities and the like. The protective garment is generally comprised of a shroud-like flexible material, which includes a longitudinally-extending horizontal opening, or slit, cut into the flexible material.

Cooperative attachment/detachment means are used for attachably/detachably affixing the flexible pouch to the interior of the longitudinal horizontal opening in the protective garment so that the contents of the flexible pouch can be accessed from the exterior of the flexible garment during use. Such cooperative attachment/detachment means may include hook and loop fasteners, such as Velcro.™ Finally, closure means may be attached to the bib for covering the longitudinal horizontal opening and for covering the opening in the neck portion of the flexible pouch. Such closure means may include a flap affixed to the protective garment. This flap will overlay the longitudinal horizontal opening. This flap is closed through the use of hook and loop strips affixed to the protective garment and the flap, such that the hook and loop strips cooperate to close the horizontal opening of the protective garment and of the flexible pouch.

The present invention overcomes the disadvantages found in prior pouches and pockets by providing a flexible pouch which includes a neck portion that can be securely closed through the use of a draw string or hook and loop fasteners, such as Velcro.™ This pouch is also constructed of a flexible material with a water-impermeable layer so that it may expand to accommodate tissues, pre-moistened towelettes or other cleaning or drying materials. This flexible pouch is generally attached to the interior of a longitudinally extending horizontal opening cut into the bib or shroud. Therefore, the flexible pouch is retained behind the bib or shroud so that it does not interfere with movement, eating, the application of cosmetics or the styling of hair. In addition, although detachable, the flexible pouch of the present invention is not exposed and is not likely to accidentally become detached during use. Even so, easy and rapid access to the cleaning and drying materials is still provided through the longitudinal, horizontal opening in the bib or shroud to which the flexible pouch is attached.

DETAILED DESCRIPTION OF THE INVENTION

Figure 1:
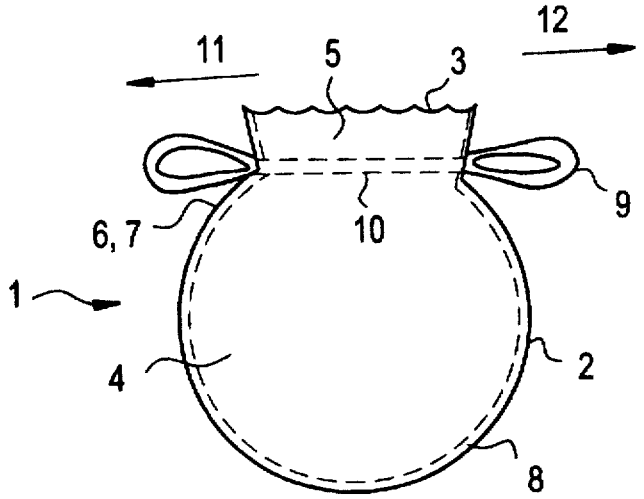
FIG. 1 illustrates a front elevational view of the flexible pouch.

Reference will now be made in detail to the present preferred embodiments of the invention, an example of which is illustrated in the accompanying drawings in which like reference characters refer to corresponding elements.

Figure 2:
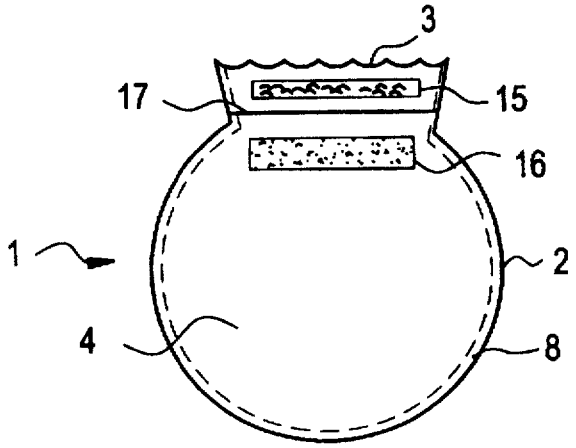
FIG. 2 illustrates a front elevational view of the flexible pouch with cooperative closure means.
Figure 3:
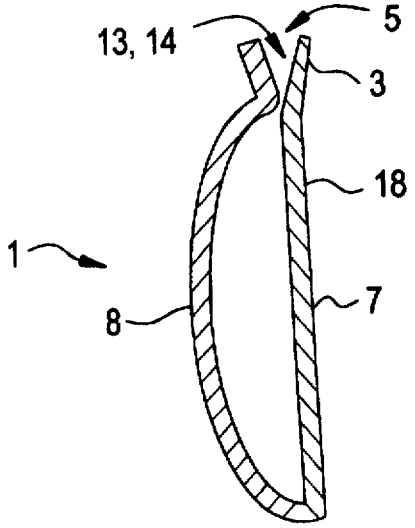
FIG. 3 illustrates a side elevational, cross-sectional view of the flexible pouch with cooperative closure means.

Referring to FIGS. 1, 2 and 3, the flexible pouch of the present invention, generally denoted as 1, is shown. The flexible pouch includes a container portion 2 and a neck portion 3. The neck portion 3 is integrally connected to the container portion 2. The container portion 2 is constructed of a flexible material 4 which allows it to expand to accommodate the insertion and storage of cleaning articles therein for use during eating, cosmetic application, hair styling or recreational activities. The neck portion 3 is also constructed of flexible material 4. The neck portion includes an opening 5 at the upper end of a sufficient size to allow the insertion and extraction of cleaning articles to and from the container portion 2.

The flexible material 4 of which the container portion 2 and neck portion 3 are constructed includes two panels, 6 and 7, of equal size and shape which are securely and cooperatively affixed to one another in parallel orientation about their circumferential edges, through the use of stitching 8 or adhesive bonding (not shown), to form the flexible pouch 1. Closure means are attached to the neck portion 3 for narrowing the opening 5 made thereby.

Such closure means may include a drawstring 9 which is contained in an integral sheath 10 which runs longitudinally through the neck portion 3. The drawstring 9 continuously and circumferentially extends around the base of the neck and when opposing radial forces 11 and 12 are exerted on the drawstring 9, the neck portion 3 is constricted at integral sheath 10. Other closure means, as shown in FIG. 3, may consist of cooperative hook and loop strips, 13 and 14, which are affixed to opposite sides of the interior of the neck portion. Alternatively, as shown in FIG. 2, hook and loop strips 15 and 16 may be placed in parallel fashion on opposite sides of crease 17, such that when the flexible material 4 of neck portion 3 is folded at crease 17, the hook and loop strips 15 and 16 cooperatively attach.

Figure 4:
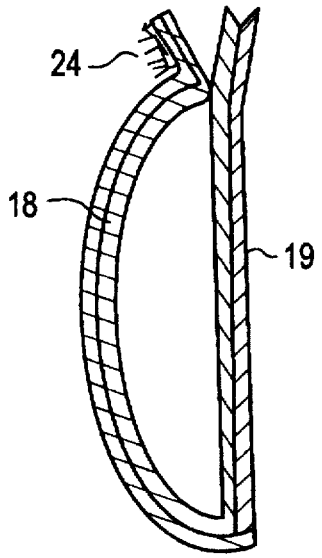
FIG. 4 illustrates a side elevational, cross-sectional view of the flexible pouch with a water-impermeable layer, a fabric layer and cooperative attachment means.

The user of the flexible pouch may also wish to store pre-moistened towelettes for use in cleaning applications in the pouch. In such a situation, the flexible material of which the flexible pouch is constructed may be made of a water impermeable fabric or material 18. For cosmetic purposes, as is shown in FIG. 4, a water impermeable layer of flexible material 18 may be surrounded by a second layer of fabric material 19, which augments the appearance of the flexible pouch 1.

Figure 5:
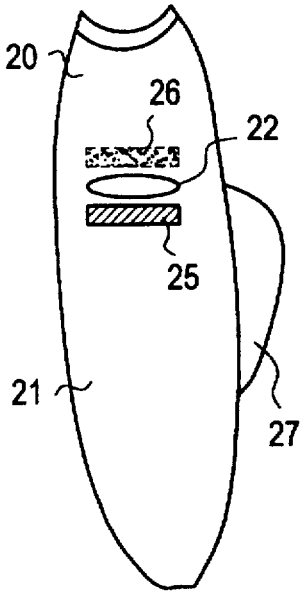
FIG. 5 illustrates a side elevational view of the protective garment with the flexible pouch attached to its underside.
Figure 6:
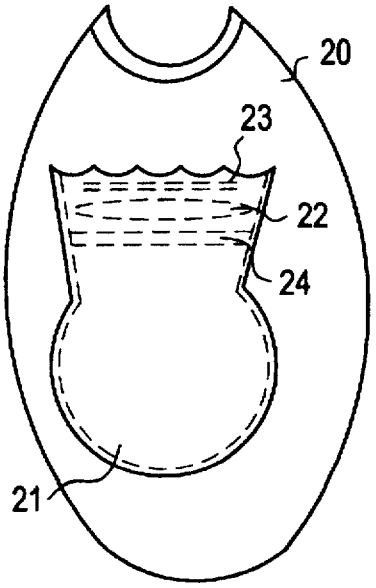
FIG. 6 illustrates a rear elevational view of the protective garment with the flexible pouch attached thereto.
Figure 7:
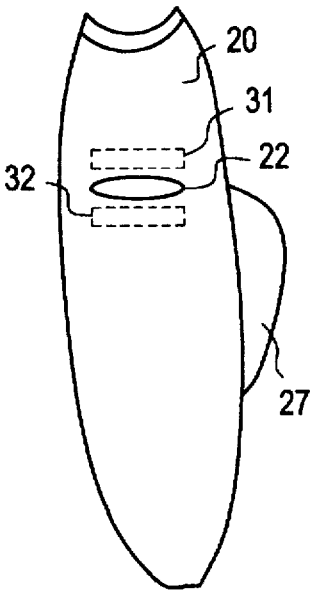
FIG. 7 illustrates a side elevational view of the protective garment with the flexible pouch attached to its underside.

This invention, in another embodiment shown in FIGS. 5, 6 and 7, includes the use of the flexible pouch 1 in conjunction with a protective garment 20, such as a bib, smock, shroud or cape that is used during eating, the application of cosmetics, hair styling, recreational activities or the like. The protective garment 20 is generally comprised of a shroud-like flexible material 21, which includes a longitudinally-extending horizontal opening 22, or slit, cut into the flexible material 21.

Hook and loop attachment/detachment means 23 and 24 are used for attachably/detachably affixing said flexible pouch 1 to the interior of the longitudinal horizontal opening 22 of the protective garment 20 at cooperative attachment means 25 and 26, respectively. In this way the contents of said flexible pouch 1 can be accessed from the exterior of the protective garment 20 during use. Such hook and loop cooperative attachment/detachment means 23, 24, 25 and 26 may consist of fasteners, such as Velcro.™

Finally, closure means may be attached to the bib for covering said longitudinal horizontal opening 22 and for covering the opening in the neck portion 3 of the flexible pouch 1 when not in use. Such closure means may include a flap 27 affixed to the protective garment at seam 28. This flap 27 may fold at seam 28 to overlay the longitudinal horizontal opening 22 of the protective garment 20. The flap 27 is closed through the use of cooperative hook and loop strips 29 and 30, which are affixed to the flap 27 and the protective garment 20, respectively, such that the hook and loop strips 29 and 30 cooperate to close said horizontal opening 22 of the protective garment 20 and of the flexible pouch 1. Alternatively, as shown in FIG. 7, the closure means employed may consist of a zipper fastener whose components 31 and 32 are affixed to the flap 27 and the flexible material 21 of protective garment 20.

It is understood that this invention is not confined to the particular construction and arrangement as herein illustrated and described, but embraces such modified forms thereof as come within the scope of the following claims.

What I claim is:

1. A protective garment comprising:

a wearable shroud, said wearable shroud being adaptable for wear as an outer layer over another garment to protect said another garment from spills, dirt, and other debris, and a flexible pouch;

said flexible pouch comprised of;

a container portion, and a neck portion, said neck portion being integrally connected to said container portion;

said container portion being comprised of a flexible material, thereby rendering said container portion expandable to accommodate the insertion and storage of cleaning articles therein;

said neck portion comprised of flexible material and including an opening at the upper end of a sufficient size to allow the insertion and extraction of cleaning articles from said container portion;

said flexible material of said neck portion and said container portion being comprised of two panels of equal size and shape which are securely and cooperatively affixed to one another in parallel orientation about their circumferential edges;

said wearable shroud comprised of a flexible material;

said wearable shroud having a longitudinally-extending horizontal opening in the flexible material;

closure means attached to said wearable shroud for covering said longitudinal horizontal opening and for covering the opening in said neck portion;

cooperative attachment/detachment means for attachably/detachably affixing said flexible pouch to the interior of said longitudinal horizontal opening in said wearable shroud so that the contents of said flexible pouch can be accessed from the exterior of said wearable shroud during use; and a flap is affixed to the protective garment which overlays said longitudinal horizontal opening and wherein said closure means comprises cooperative hook and loop strips affixed to said protective garment and said flap such that said hook and loop strips cooperate to close said horizontal opening of said protective garment.

2. The protective garment as claimed in claim 1 wherein said attachment means allows the flexible pouch to be affixed to the interior of a longitudinal horizontal opening in a garment worn during recreational activities.

3. The protective garment as claimed in claim 1 wherein said attachment means allows the flexible pouch to be affixed to the interior of a longitudinal horizontal opening in a garment used for cosmetic or hair applications.

4. The protective garment as claimed in claim 1 wherein said closure means consists of a zipper fastener.

5. The protective garment as claimed in claim 1 wherein said flexible material is water impermeable.

6. The protective garment as claimed in claim 1 wherein said flexible material further comprises a fabric layer and a water impermeable layer.

* * * * *